US006202635B1

(12) United States Patent
Evans

(10) Patent No.: US 6,202,635 B1
(45) Date of Patent: Mar. 20, 2001

(54) ARROW LAUNCHER APPARATUS

(76) Inventor: Daniel L. Evans, P.O. Box 300146, DeBorgia, MT (US) 59830

( * ) Notice: Subject to any disclaimer, the term of this patent is extended or adjusted under 35 U.S.C. 154(b) by 0 days.

(21) Appl. No.: 09/573,640

(22) Filed: May 17, 2000

Related U.S. Application Data

(60) Provisional application No. 60/134,448, filed on May 17, 1999.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 4,453,528 | | 6/1984 | Eckert | 124/44.5 |
| 5,095,884 | * | 3/1992 | Mertens | 124/44.5 |
| 5,117,803 | * | 6/1992 | Johnson | 124/44.5 |
| 5,285,764 | * | 2/1994 | Mertens | 124/44.5 |
| 5,365,912 | | 11/1994 | Pittman | 124/44.5 |
| 5,421,314 | * | 6/1995 | Kidney | 124/44.5 |
| 5,632,263 | * | 5/1997 | Sartain | 124/44.5 |
| 5,960,779 | * | 10/1999 | Jessee et al. | 124/44.5 |

* cited by examiner

*Primary Examiner*—John A. Ricci
(74) *Attorney, Agent, or Firm*—David S. Thompson

(57) ABSTRACT

An arrow launcher apparatus (10) includes a bow attachment assembly (20) which allows attachment to the middle portion of the handle of a bow in a manner that allows adjustment approximately along the axis of the arrow. An elevation adjustment assembly (40), attached to the bow attachment assembly, allows vertical adjustment against the bow attachment assembly. A windage adjustment assembly (70), attached to the elevation adjustment assembly, allows horizontal adjustment against the elevation adjustment assembly. A launcher sleeve assembly (100) is pivotably carried by the windage adjustment assembly between a forward position wherein the launcher arm (140) is lowered, and a rearward position wherein the launcher arm is raised. A pull string (160) is attached to the buss cable on a compound bow that moves down when the bowstring is pulled back. Movement of the pull string overcomes the bias of the spring (120) and lifts the launcher arm and arrow. Upon release of the bowstring, the buss cable moves up and the launcher sleeve assembly pivots to its relaxed state, thereby lowering the launcher arm.

2 Claims, 4 Drawing Sheets

ARROW LAUNCHER APPARATUS

CROSS-REFERENCES

This application is a continuation of a provisional application No. 60/134,448 filed May 17, 1999.

BACKGROUND

A limited number of launcher-type arrow rests are known and used by archery enthusiasts. While in theory such arrow rests have many advantages, there is still considerable unmet demand for an arrow rest that is more easily and accurately adjusted, both vertically and horizontally.

A primary cause of the difficulty in adjusting such arrow rests is that the structure of known arrow rests tends to rely on adjustable movement against the bow itself by the bracket or fastener which is used to directly attach the apparatus to the bow. That is, the entire apparatus is incrementally moved with respect to the bow to make an adjustment. However, such a bracket is under considerable stress, in that it receives a shock each time an arrow is released. The shock is typically greater to this portion of the apparatus than to other portions of the apparatus, since the weight of the entire remainder of the apparatus is supported by this bracket. Such repeated shocks will eventually incrementally change the position of the bracket, thereby resulting in degradation of accuracy.

A further cause of the difficulty in adjusting such arrow rests is that the means for adjustment is frequently based on the degree to which a bolt or screw extends or protrudes from a surface. In an apparatus based on such a structure, to change the adjustment an additional quarter-turn of a bolt may be indicated, thereby causing a different length of the bolt to extend past a surface. However, no locking structure prevents rotation of the bolt, and impact and vibration may cause the bolt to move on its own.

Similarly, where an adjustment is made by turning a structure in a rotary manner about a bolt, it is typically the case that the bolt will either be over-tightened or will slip. Neither circumstance is desirable.

Therefore, what is needed is an improved arrow launcher apparatus having an improved adjustment structure. The adjustment structure must not depend on moving that portion of the apparatus directly attached to the bow, with respect to the bow. Similarly, the adjustment structure must not depend on the degree to which a bolt or screw extends from a surface. And further, the adjustment structure must not employ a component that is incrementally revolved about a bolt, and must result in unimpeded clearance for the fletching of the arrow as it goes by.

SUMMARY

The present invention is directed to an apparatus that satisfies the above needs. A novel arrow launcher is disclosed that provides some or all of the following structures.

(A) A bow attachment assembly adjustably attaches to a bow at a point opposite the arrow. A pair of elongated bow attachment slots defined in the body of the assembly allow for some adjustment of the precise location of attachment to the bow about a direction generally parallel to the arrow prior to flight, allowing adjustment for arrow length. A vertically oriented protrusion defines upper and lower threaded holes for adjustable attachment to an elevation adjustment assembly.

(B) An elevation adjustment assembly adjustably attaches to the vertically oriented protrusion of the bow attachment assembly, thereby allowing vertical adjustment. A bow attachment block defines a vertically oriented recess which mates with the vertically oriented protrusion. An elongated vertical slot, defined through the bow attachment block, receives an elevation attachment bolt which is threaded into one of the upper and lower threaded holes. A windage attachment block carries a horizontally oriented protrusion which typically defines middle, left and right threaded holes.

(C) A windage adjustment assembly adjustably attaches to the horizontally oriented protrusion of the windage attachment block, thereby allowing left to right adjustment. A horizontal adjustment block defines a horizontally oriented recess sized to mate with the horizontally oriented protrusion. An elongated horizontally oriented slot, defined through the horizontal adjustment block, receives a windage adjustment bolt which is threaded into one of the middle, left or right threaded holes. A launcher attachment block defines a launcher sleeve recess and an inner spring attachment hole.

(D) A launcher sleeve assembly is pivotally carried by the launcher sleeve recess about an axis that is generally perpendicular to both the arrow and relaxed bow string. An insert tube portion of the launcher sleeve inserts into the launcher sleeve recess of the launcher attachment block. An insert stop prevents over insertion. A spring biases the launcher sleeve to rotate until a tab, carried by the launcher sleeve, contacts a forward surface defined on the launcher attachment block. A first end of a pull string is attached to a hole defined in the tab, while a second end of the pull string is attached to the buss cable that moves down as the bowstring is drawn. Pulling back on the bowstring causes the pull string to pull on the tab, rotating the launcher sleeve against the spring bias.

(E) A launcher arm is carried by the launcher sleeve, and therefore pivots with the launcher sleeve from a lowered position, when the bowstring is relaxed, to a raised position, when the bowstring is retracted. A preferred launcher arm provides left and right forks which cradle the arrow prior to release of the bowstring. Upon release of the bowstring, the spring rotates the launcher sleeve assembly, causing the launcher arm to move into the lowered position, allowing the arrow and its fletching to pass by unobstructed.

It is therefore a primary advantage of the present invention to provide a novel arrow launcher apparatus that elevates an arrow prior to release of the bowstring, and which biases the launcher arm to a lowered position immediately after release of the bowstring, allowing the arrow and its fletching to pass unobstructed.

Another advantage of the present invention is to provide a novel arrow launcher apparatus that allows for vertical adjustment for range; horizontal adjustment for windage; forward to back adjustment to more correctly attach to the bow upon which it is attached; and provides compensation for different arrow lengths.

A still further advantage of the present invention is to provide a novel arrow launcher apparatus that provides mated pairs of vertically and horizontally oriented protrusions and recesses which tend to allow movement between adjacent parts only in the direction in which an adjustment is being made, and which prevents movement in the perpendicular direction.

DRAWINGS

These and other features, aspects, and advantages of the present invention will become better understood with regard to the following description, appended claims, and accompanying drawings where:

DESCRIPTION

Figure 1:
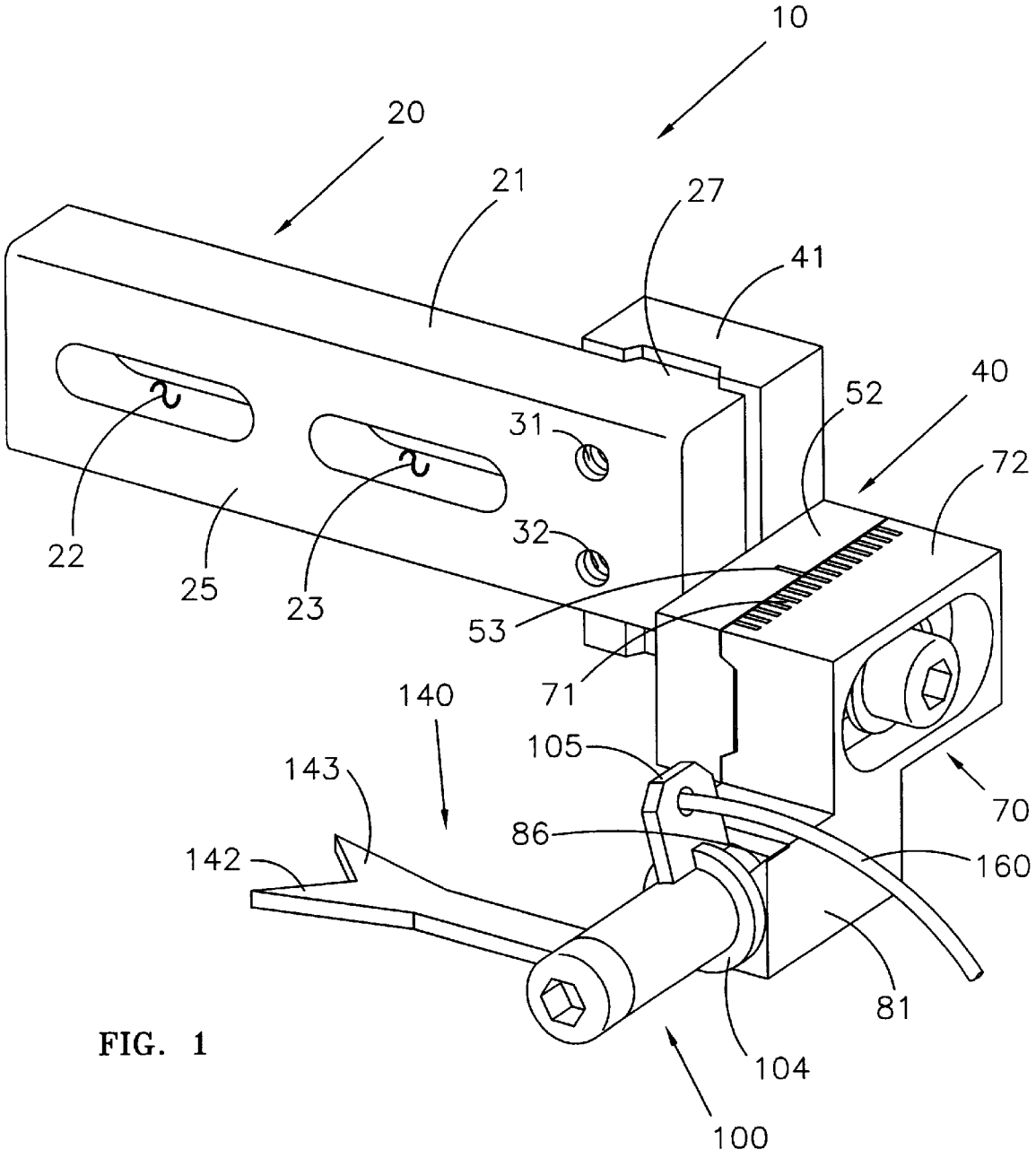
FIG. 1 is a perspective view of a version of the arrow launcher having the arrow rest in the lowered position.

Referring in generally to FIGS. 1 through 10, a preferred version of the arrow launcher apparatus constructed in accordance with the principles of the invention is seen. The launcher 10 includes a bow attachment assembly 20 which allows attachment to the middle portion of the handle of a bow in a manner that allows adjustment approximately along the axis of the arrow. An elevation adjustment assembly 40, attached to the bow attachment assembly, allows vertical adjustment against the bow attachment assembly. A windage adjustment assembly 70, attached to the elevation adjustment assembly, allows horizontal adjustment against the elevation adjustment assembly. A launcher sleeve assembly 100 is pivotably carried by the windage adjustment assembly between a forward position wherein the launcher arm 140 is lowered, and a rearward position wherein the launcher arm is raised. A pull string 160 is attached to the buss cable that moves down when the bowstring is pulled back. Such cables are present on known compound bows. Movement of the pull string overcomes the bias of the spring 120 and lifts the launcher arm and arrow. Upon release of the bowstring, the buss cable moves up and the launcher sleeve assembly pivots to its relaxed state, thereby lowering the launcher arm.

Figure 2:
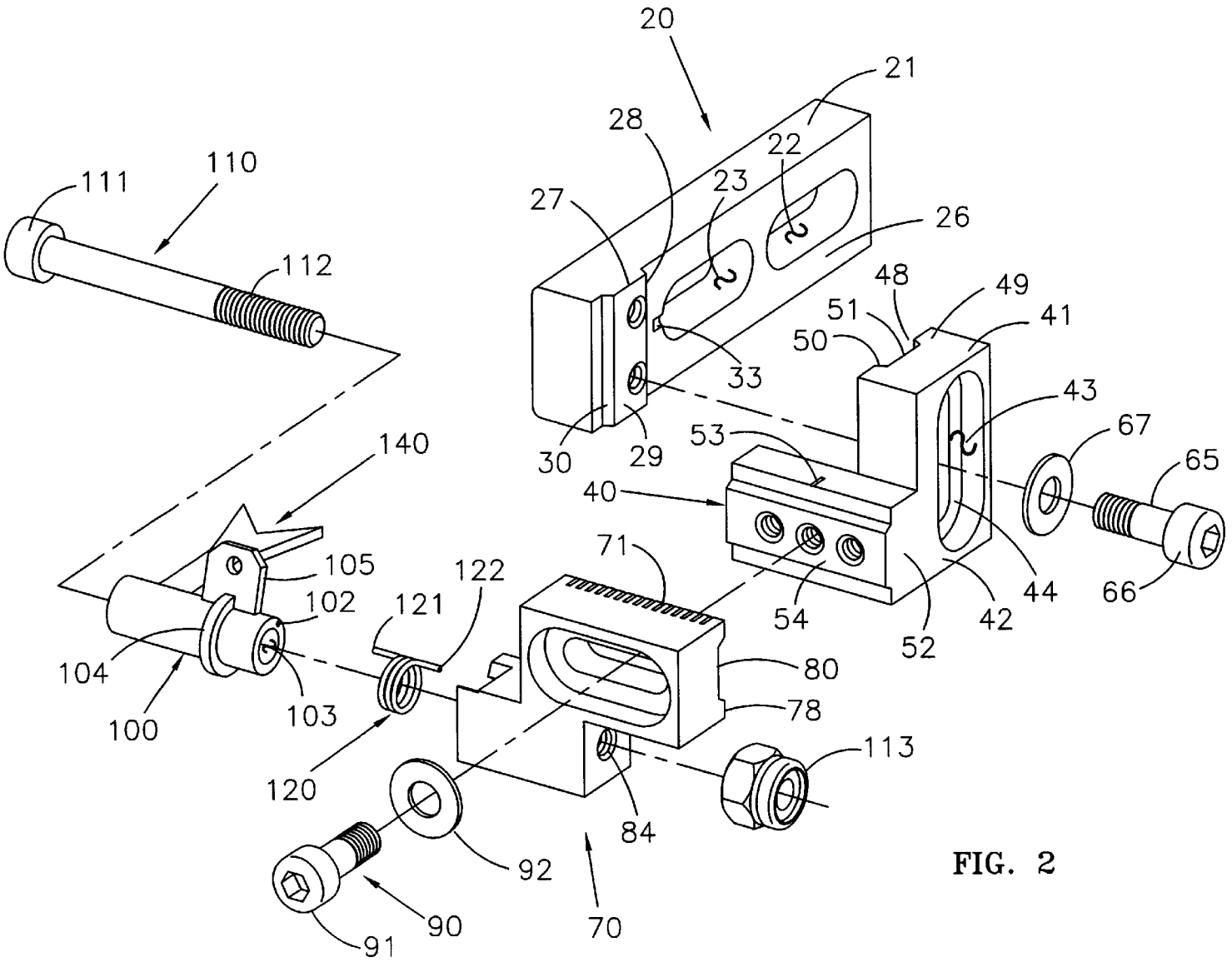
FIG. 2 is a reverse angle perspective exploded view of the arrow launcher of FIG. 1.
Figure 3:
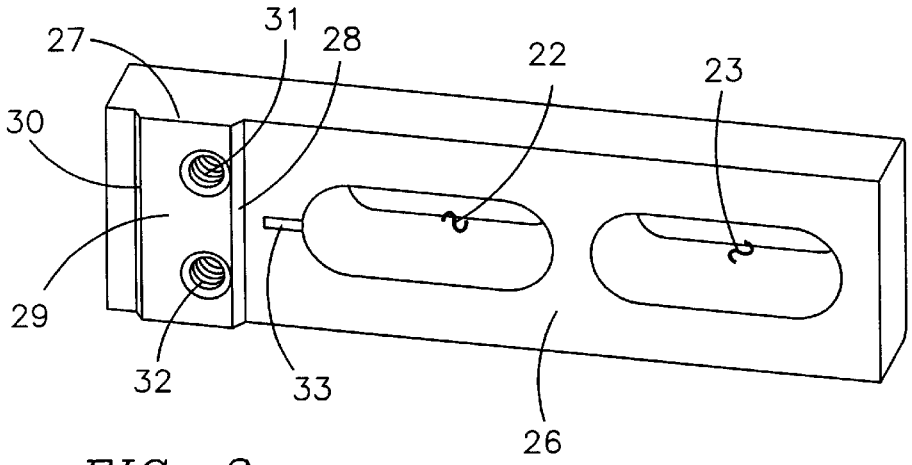
FIG. 3 is a side perspective view of the bow attachment assembly.

A bow attachment assembly 20 is seen in FIGS. 1, 2 and 3. The bow attachment assembly attaches to the handle portion of a bow. Referring particularly to FIG. 1, the bow would be mounted against the visible elongated inside surface 25. The launcher arm 140 would therefore be on the opposite side of the bow, allowing a forwardly directed arrow, pointing to the left, to be supported.

A preferred version of the bow attachment assembly 20 includes an elongated body 21 having elongated forward and rearward bow attachment slots 22, 23 defined between an inside surface 25 and an outside surface 26. Bolts or other fasteners (not shown) allow attachment of the bow. Due to the elongated structure of the slots 22, 23, the forward-to-back location of the arrow launcher 10 may be adjusted. This allows adjustment for the arrow length, in that the arrow launcher 10 may be moved forward where the arrow length is greater, and backward where the arrow length is shorter.

Referring to FIG. 2, the rearward end of the outside surface defines a vertically oriented protrusion 27 which mates with a similarly sized vertically oriented recess 48 on the elevation adjustment assembly 40. The vertically oriented protrusion 27 includes a forward inclined surface 28, an elevated flat surface 29 and a rearward inclined surface 30.

Upper and lower threaded holes 31, 32 are sized to allow the elevation adjustment bolt 65 to fasten the elevation adjustment assembly 40 to the bow attachment assembly 20. As is particularly seen in FIG. 3, in a preferred embodiment, the threaded holes 31, 32 are located to one side of the center of the elevated flat surface 29 of the vertical protrusion. The head 66 of the elevation attachment bolt is recessed into the elongated vertical slot 43 until the head touches the shoulder 44, thereby clamping the elevation adjustment assembly against the bow attachment assembly.

The elevation adjustment assembly 40 is seen in FIGS. 1, 2, 4 and 5, and includes a bow attachment block 41 and a windage attachment block 52. The bow attachment block attaches to the bow attachment assembly, while the windage attachment block 52 adjustably attaches to a windage adjustment assembly 70.

Figure 4:
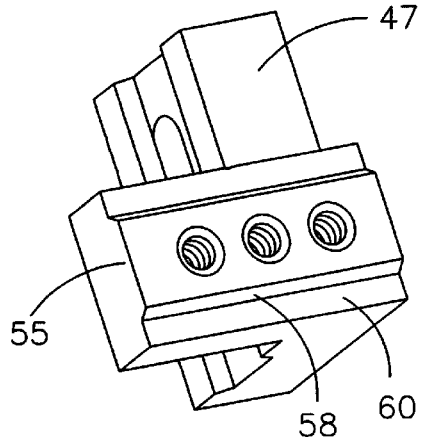
FIG. 4 is a perspective view of the elevation adjustment assembly.

Referring primarily to FIGS. 2 and 4, an elongated vertical slot 43 is defined between an outside surface 42 and an inside surface 47 of the bow attachment block 41. A shoulder 44, defined within the elongated vertical slot, allows the head of the elevation adjustment bolt 65 passing through the slot to be recessed. The elongated nature of the slot allows the elevation adjustment assembly 40 to be raised and lowered somewhat, before tightening the bolt. As seen in FIG. 4, due to the off-center location of the holes 31, 32 with respect to the elevated flat surface 29 (seen best in FIG. 3), the wide edge surface 46 to the left of the slot 43 is somewhat wider than the narrow edge surface 45 to the right of the slot.

Referring particularly to FIG. 2, a vertically oriented recess 48 is defined on the inside surface 47 of the bow attachment block. The vertically oriented recess is sized to mate with the vertically oriented protrusion 27 of the bow attachment assembly. The vertically oriented recess has two feet 49 separated from a recesses flat surface 51 by inclined surfaces 50.

Figure 5:
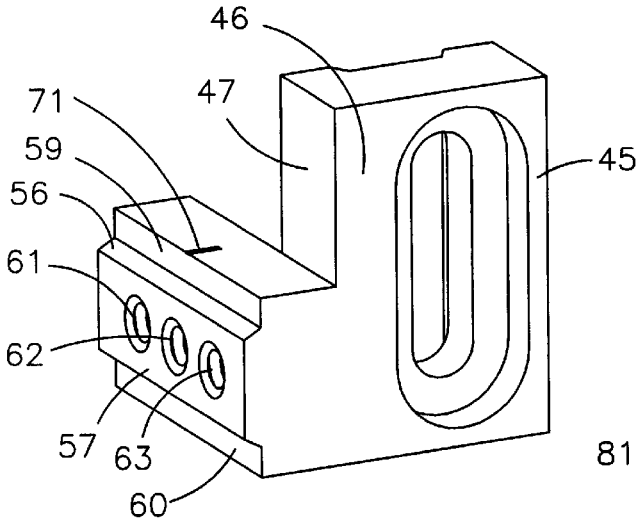
FIG. 5 is a perspective view of the elevation adjustment assembly.

Referring particularly to FIG. 2 and also to FIGS. 4 and 5, the windage attachment block 52 allows left-to-right adjustable attachment to the windage adjustment assembly 70, thereby allowing compensation, i.e. tuning arrow flight, for the effects of the flexibility of any individual arrow. An indicator mark 53 is defined on the windage attachment block adjacent to a plurality of adjustment indicators 71 defined on the windage adjustment assembly 70. Movement of the relative position of the mark and indicators allows for fine-tuning of the left-to-right orientation of the arrow, which can compensate for different flexibility or other characteristics of any arrow.

An inside surface 54 of the windage attachment block 52 defines a horizontally oriented protrusion 55, which engages the horizontally oriented recess 77 of the horizontal adjustment block 72 of the windage adjustment assembly 70. The horizontally oriented protrusion 55 is located between upper and lower flat surfaces 59, 60, and provides an upper angled surface 56, an elevated flat surface 57 and a lower angled surface 58.

In a preferred embodiment, left middle and right holes 61, 62, 63 are threaded to engage a windage attachment bolt 90.

As seen in FIGS. 1, 2, 6 and 7, a windage adjustment assembly 70 provides a horizontal adjustment block 72 and a launcher attachment block 81. The horizontal adjustment block attaches adjustably to the windage attachment block 52, while the launcher attachment block attaches to the launcher sleeve assembly. Movement of the horizontal adjustment block 72 against the windage attachment block 52 is easily measured by means of the windage adjustment indicators 71 against the indicator mark 53.

Figure 6:
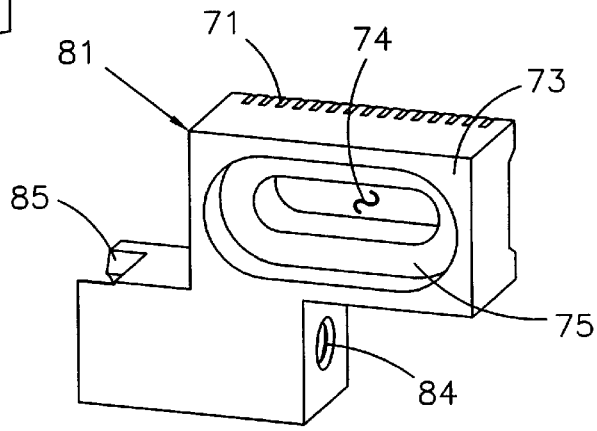
FIG. 6 is a front perspective view of the windage adjustment assembly.

Continuing to refer to FIGS. 1, 2, and 6, an elongated horizontal slot 74 is defined between an outside surface 73 of the horizontal adjustment block 72 an inside surface 76. A preferred slot has a recessed shoulder 75, in a structure similar to that of the elongated vertical slot 43.

A windage adjustment bolt 90 passes through the elongated horizontally oriented slot defined through the horizontal adjustment block, and is threaded into one of the middle, left or right threaded holes 61, 62, 63, as required to result in the correct wind adjustment. Once fully inserted, the head 91 of the bolt rests on the shoulder 75 and is generally recessed within the horizontal adjustment block 72.

An inside surface 76 defines a horizontally oriented recess 77, sized to engage the horizontally oriented protrusion 55 of the windage attachment block 52. The horizontally oriented protrusion provides opposed feet 78 and inclined surfaces 79 separated by a recessed flat surface 80.

Figure 7:
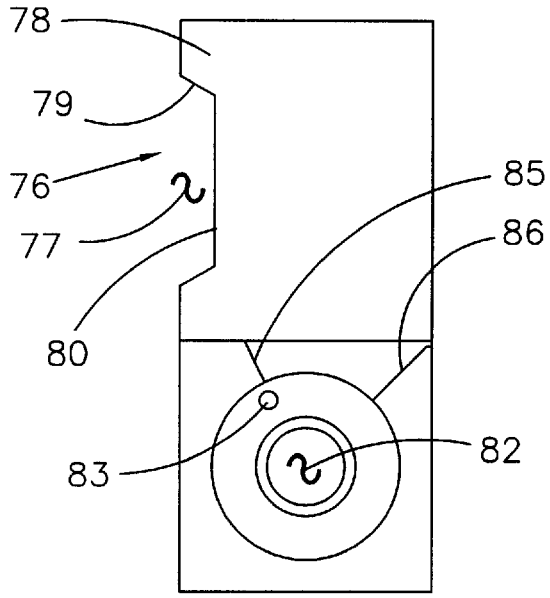
FIG. 7 is a side orthographic view of the windage adjustment assembly.

As seen in FIGS. 1, 2, and 7, the launcher attachment block 81 allows attachment of the launcher sleeve assembly 100. A launcher sleeve recess 82 is sized to allow rotation of the insert tube 101 of the launcher sleeve assembly.

A threaded channel 84 is sized for attachment of the launcher sleeve attachment bolt 110.

As seen in FIGS. 1, 2, and 8–10, a launcher sleeve assembly 100 is pivotably carried by the launcher attachment block 81 of the windage adjustment assembly 70. A preferred launcher sleeve assembly provides a generally tubular body 107 having an insert tube portion 101, a stop 104 and a tab 105. The insert tube 101 is sized for insertion into the launcher sleeve recess 82, until the insert stop 104 makes contact with the launcher attachment block.

The tab 105 is radially directed from the tubular body of the launcher sleeve, and allows the launcher sleeve to pivot between a forward position and a rearward position. In the forward position seen in FIGS. 1 and 10, wherein the launcher arm 140 is lowered, the tab is adjacent to a forward surface 85 of the launcher attachment block. In the rearward position seen in FIG. 9, wherein the launcher arm is raised, the tab is adjacent to a rearward surface 86 of the launcher attachment block.

A launcher sleeve attachment bolt 110 passes through axial channel 103 defined in the tubular body 107 of the launcher sleeve and through the threaded channel 84 of the launcher attachment block 81. The threaded end 112 is secured with a lock nut 113 or similar fastener. The diameter of the head 111 of the bolt is typically the same as the outside diameter of the tubular body 107.

A spring 120 or similar biasing device is attached to both the launcher sleeve assembly 100 and to the launcher attachment block 81. A first end of the spring is attached to the inner spring attachment hole 83 defined in the launcher attachment block, while a second end of the spring is attached to the spring attachment hole 102 defined in the insert tube.

Figure 10:
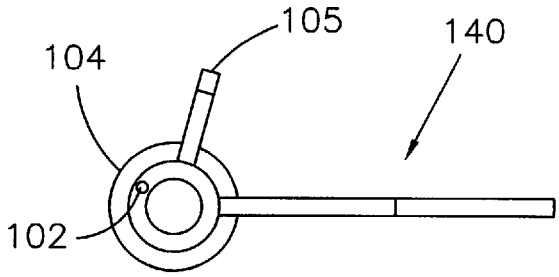
FIG. 10 is a view similar to that of FIG. 9, after the bowstring has been released, and the launcher arm has lowed to its relaxed position.
Figure 8:
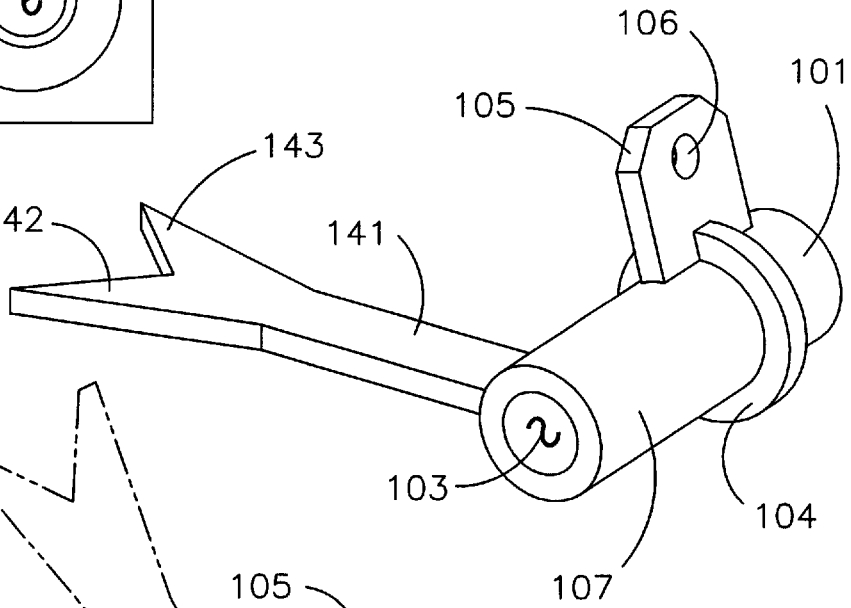
FIG. 8 is a front perspective view of the launcher sleeve and launcher arm assemblies.

In its relaxed state, the spring biases the launcher sleeve assembly forwardly, as seen in FIGS. 1 and 10, to the point where the tab 105 contacts the forward surface 85 of the launcher attachment block. In its stressed state, the spring is overcome by the force exerted by the pull string 160, thereby pivoting the tab into a position seen in FIG. 9, wherein the tab moves into contact with the rear surface 86.

As seen in FIGS. 1, 2, 8 and 9, a launcher arm 140 is carried attached to an outer surface of the tubular body 107. A preferred launcher arm includes a generally planar body 141 having left and right forks 142, 143 sized to cradle an arrow.

A pull string 160 is attached at a first end to the string attachment hole 106 defined in the tab 105, and at a second end to a position on the buss cable on a compound bow that moves down as the bowstring is drawn. Alternatively, the bowstring may by of the conventional type, wherein a point on the bowstring moves rearwardly as the string is pulled back, and snaps forwardly as the string is released.

To use the arrow launcher apparatus 10, the bow attachment assembly 20 is attached to the right side of the middle portion of the bow. The launcher arm is positioned on the left side of the bow. One or more bolts may be used; the bolt(s) passing through the forward and/or rearward bow attachment slots 22, 23. The arrow launcher may be moved forward or backward, prior to tightening the bolt(s), to compensate for arrow length.

Figure 9:
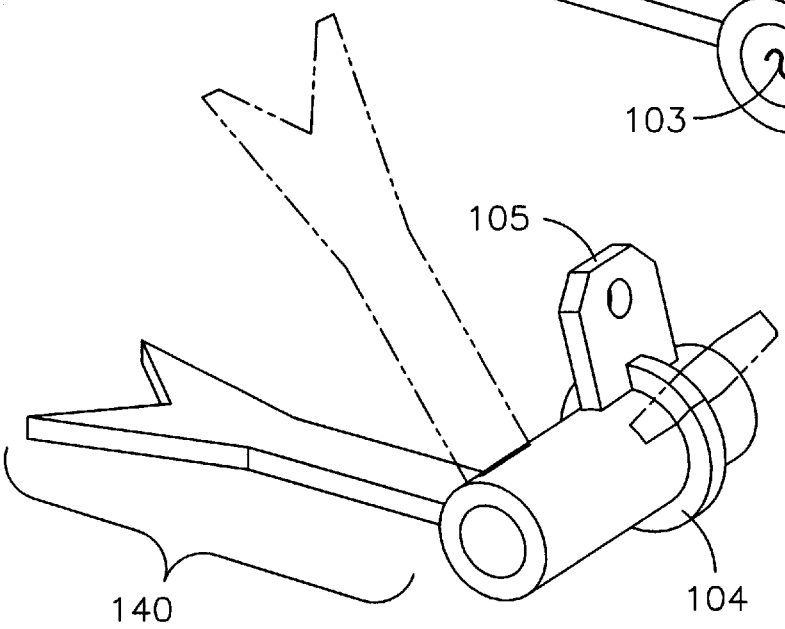
FIG. 9 is an perspective view of the launcher sleeve and launcher arm assemblies, with the launcher arm in the raised position in dotted outline, prior to release of the bowstring, and in the solid line, illustrating its position after the arrow's release.

An arrow is supported between the forks 142, 143 of the launcher arm 140, and the bowstring is withdrawn. Pulling back on the bowstring causes a buss cable to go down, which results in the pull string causing the tab 105 to pivot, against the the bias of spring 120, until the tab touches the rear surface 86 of the launcher attachment block 81. This movement results in the raising of the launcher arm 140, as seen in FIG. 9.

Release of the bowstring results in movement in the opposite direction. The spring 120 relaxes, rotating the launcher sleeve assembly to the position seen in FIG. 10, with the tab 105 in contact with the forward surface 85 and the launcher arm 140 in the lowered position. The arrow is then able to pass over the launcher arm with out making contact.

The range of the arrow can be adjusted by moving the bow attachment block 41 against the vertically oriented protrusion 27 of the bow attachment assembly. The elevation adjustment bolt 65 is loosened and the vertically oriented recess 48 is moved against the vertically oriented protrusion 27. The bolt is then tightened.

Similarly, the left-to-right adjustment may be made to compensate for the true flight of the arrow, which may be influenced by such conditions as the flexibility of the arrow. The windage adjustment bolt 90 is loosened and the horizontally oriented recess 77 of the horizontal adjustment block 72 is moved against the horizontally oriented protrusion 55 of the windage attachment block 52. The indicators 53, 71 are moved to an appropriate location and the bolt 90 is tightened.

The previously described versions of the present invention have many advantages, including a primary advantage of providing a novel arrow launcher apparatus that elevates an arrow prior to release of the bowstring, and which biases the launcher arm to a lowered position immediately after release of the bowstring, allowing the arrow and its fletching to pass unobstructed.

Another advantage of the present invention is to provide a novel arrow launcher apparatus that allows for vertical adjustment for range; horizontal adjustment for windage; forward to back adjustment to more correctly attach to the bow upon which it is attached; and provides compensation for different arrow lengths.

A still further advantage of the present invention is to provide a novel arrow launcher apparatus that provides mated pairs of vertically and horizontally oriented protrusions and recesses which tend to allow movement between adjacent parts only in the direction in which an adjustment is being made, and which prevents movement in the perpendicular direction.

The invention resides not in any one of these features per se, but rather in the particular combination of all of them herein disclosed and claimed and it is distinguished from the prior art in this particular combination of its structures for the functions specified.

Although the present invention has been described in considerable detail and with reference to certain preferred versions, other versions are possible. For example, while a right handed version of the invention has been described above, it is clear that a left handed version could be similarly constructed. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An arrow launcher apparatus comprising:

(A) a bow attachment assembly comprising:
- (a) an elongated body defining at least one elongated bow attachment slot; and
- (b) a vertically oriented protrusion defining at least one threaded hole;

(B) an elevation adjustment assembly attached to the bow attachment assembly, the elevation adjustment assembly comprising:
- (a) a bow attachment block defining a vertically oriented recess sized to adjustably mate with the vertically oriented protrusion;
- (b) an elevation attachment bolt, passing through an elongated vertical slot defined through the bow attachment block, and threaded into one of the at least one threaded holes; and
- (c) a windage attachment block defining a horizontally oriented protrusion defining at least one further threaded hole;

(C) a windage adjustment assembly comprising:
- (a) a horizontal adjustment block defining a horizontally oriented recess sized to mate with the horizontally oriented protrusion;
- (b) a windage adjustment bolt passing through an elongated horizontally oriented slot defined through the horizontal adjustment block, and threaded into the at least one further threaded hole; and
- (c) a launcher attachment block defining a launcher sleeve recess;

(D) a launcher sleeve assembly, pivotally carried by the launcher sleeve recess comprising:
- (a) an insert tube inserted into the launcher sleeve recess of the launcher attachment block; and
- (b) a tab, carried by the insert tube, pivotable between contact with a forward surface of the launcher attachment block and a rear surface of the launcher attachment block;

(E) a launcher arm, carried by the launcher sleeve; and (F) biasing spring means, attached to the launcher sleeve assembly and to the launcher attachment block, for biasing the launcher arm to a lowered position.

2. An arrow launcher apparatus comprising:

(A) a bow attachment assembly comprising:
- (a) an elongated body defining a pair of elongated bow attachment slots; and
- (b) a vertically oriented protrusion defining upper and lower threaded holes;

(B) an elevation adjustment assembly attached to the bow attachment assembly, the elevation adjustment assembly comprising:
- (a) a bow attachment block defining a vertically oriented recess sized to adjustably mate with the vertically oriented protrusion of the bow attachment assembly;
- (b) an elevation attachment bolt, passing through an elongated vertical slot defined through the bow attachment block, and threaded into one of the upper and lower threaded holes; and
- (c) a windage attachment block defining a horizontally oriented protrusion defining middle, left and right threaded holes;

(C) a windage adjustment assembly comprising:
- (a) a horizontal adjustment block defining a horizontally oriented recess sized to mate with the horizontally oriented protrusion, thereby allowing adjustable attachment between the windage adjustment assembly and the horizontally oriented protrusion of the windage attachment block of the elevation adjustment assembly;
- (b) a windage adjustment bolt passing through an elongated horizontally oriented slot defined through the horizontal adjustment block, and threaded into one of the middle, left or right threaded holes; and
- (c) a launcher attachment block defining a launcher sleeve recess;

(D) a launcher sleeve assembly, pivotally carried by the launcher sleeve recess comprising:
- (a) an insert tube inserted into the launcher sleeve recess of the launcher attachment block;
- (b) insert stop means, carried by the insert tube, for preventing over insertion of the insert tube into the launcher sleeve recess;
- (c) a tab, carried by the insert tube, pivotable between contact with a forward surface of the launcher attachment block and a rear surface of the launcher attachment block; and
- (d) a launcher sleeve attachment bolt, passing through the launcher sleeve assembly and connecting to the launcher attachment block;

(E) a launcher arm, carried by the launcher sleeve between a lowered position and a raised position, comprising a body supporting left and right forks;

(F) biasing spring means, attached to the launcher sleeve assembly and to the launcher attachment block, for biasing the launcher sleeve to rotate until the tab, contacts a forward surface defined on the launcher attachment block; and (G) a pull string, having a first end attached to a hole defined in the tab, whereby movement of the pull string pulls on the tab, rotating the launcher sleeve against spring bias until the tab contacts a rear surface defined on the launcher attachment block and the launcher arm is raised.

* * * * *